US006983509B2

(12) United States Patent
Lin

(10) Patent No.: US 6,983,509 B2
(45) Date of Patent: Jan. 10, 2006

(54) SWEEPING AND WRINGING APPARATUS

(75) Inventor: Ming-Hsien Lin, Chia Yi Hsien (TW)

(73) Assignee: Giant Lead Inc., Chia Ya Hsien (TW)

( * ) Notice: Subject to any disclaimer, the term of this patent is extended or adjusted under 35 U.S.C. 154(b) by 292 days.

(21) Appl. No.: 10/417,757

(22) Filed: Apr. 16, 2003

(65) Prior Publication Data

US 2004/0148722 A1 Aug. 5, 2004

(30) Foreign Application Priority Data

Jan. 30, 2003 (TW) ..... 92201979 U

(51) Int. Cl.
*A47L 13/146* (2006.01)

(52) U.S. Cl. ..... 15/119.2

(58) Field of Classification Search ..... 15/116.1, 15/116.2, 119.1, 119.2
See application file for complete search history.

(56) References Cited

U.S. PATENT DOCUMENTS 2,926,373 A * 3/1960 Knapp ..... 15/119.2

3,289,233 A * 12/1966 Smyth et al. ..... 15/116.1

* cited by examiner

*Primary Examiner*—Mark Spisich
(74) *Attorney, Agent, or Firm*—Pro-Techtor Int'l Services

(57) ABSTRACT

A sweeping and wringing apparatus, comprising: a handle; a moving bar, having an upper end that is hingedly connected with the handle at a middle position thereof and a lower end that is placed inside the handle at a lower position thereof; a transmission rod, glidingly mounted within the handle and having an upper end that is hingedly connected with the lower end of the moving bar; a frame, having a vertical part with an upper end that is attached to the handle at a lower end thereof and a horizontal part with two far ends that define left and right sides; a pair of hinge plates, having an upper end that is hingedly connected with one of the far ends of said horizontal part of the frame and having a bent part with a bolt; a pulling element, attached to the lower end of the transmission rod; a pair of holding plates, having vertical ribs with inner ends that are hingedly connected with the pulling element and extending symmetrically to the left and right, respectively; and a cleaning head, fastened to the pair of holding plates, comprising a positioning plate and a cleaning element fastened to the positioning plate on a lower side thereof.

6 Claims, 10 Drawing Sheets

SWEEPING AND WRINGING APPARATUS

BACKGROUND OF THE INVENTION

1. Field of the Invention

The present invention relates to a sweeping and wringing apparatus, particularly to a sweeping and wringing apparatus which allows to be effectively wrung dry in an inward folding squeezing movement.

2. Description of Related Art

Conventionally, for wet-cleaning a floor, a sweeper with a long handle is used to avoid to have to bend down during the cleaning work. The handle has a front end to which a cleaning element is attached, which is a piece of cloth or a sponge. However, this kind of sweeper does not have a device allowing to wring the cleaning element dry, so after the cleaning work the cleaning element has to be wrung dry by hand or by stepping thereon by foot, which is inconvenient.

To counter this difficulty, a sweeping and wringing apparatus with a cleaning element that allows to be squeezed has been brought on the market, mainly comprising, as shown in FIG. 13: a handle 1; a sponge 2; a connecting piece 3, attached to a lower end of the handle 1; a gripping element 4, made of punched metal and gripping an upper part of the sponge 2; a connecting rod assembly 5, having L-shaped elements fastened to the gripping element 4, for transmitting a downward movement to the sponge 2; a pair of roll bars 6, attached to a lower side of the connecting piece 3; and a lever 7, connected with the connecting rod assembly 5. When the lever 7 is lifted, the connecting rod assembly 5 is pulled up, dragging upward the sponge 2, which is subsequently squeezed between the pair of roll bars 6, so that water contained in the sponge 2 is wrung out.

This conventional sweeping and wringing apparatus allows to press out water contained therein, but has the following shortcomings:

1. For pressing out water, the sponge 2 is drawn through the roll bars 6. The surface of the sponge 2 that is pressed is comparatively small. In practice, pulling up of the lever 7 is often done fast, with the sponge 2 rapidly slipping through between the roll bars 6, so that the sponge 2 is not wrung dry.
2. The sponge 2 is held by the gripping element 4 and fastened to the connecting rod assembly 5 by a screw 8. After prolonged use, however, the surface of the sponge 2 becomes dirty and the screw 8 becomes rusty to the point of the sponge 2 not being replaceable.
3. Since the sponge 2 is held fastened to the connecting rod assembly 5 by the screw 8, mounting and dismounting thereof has to be performed by a tool or a machine, which is inconvenient and expensive and also impractical during use.

SUMMARY OF THE INVENTION

It is an object of the present invention to provide a sweeping and wringing apparatus which is good-looking and effective.

Another object of the present invention is to provide a sweeping and wringing apparatus having a cleaning element that is easily replaceable.

A further object of the present invention is to provide a sweeping and wringing apparatus which is easily wrung dry and which is inexpensively manufactured.

A further object of the present invention is to provide a sweeping and wringing apparatus which is convenient to assemble and disassemble.

The present invention can be more fully understood by reference to the following description and accompanying drawings.

DETAILED DESCRIPTION OF THE PREFERRED EMBODIMENTS

Figure 1:
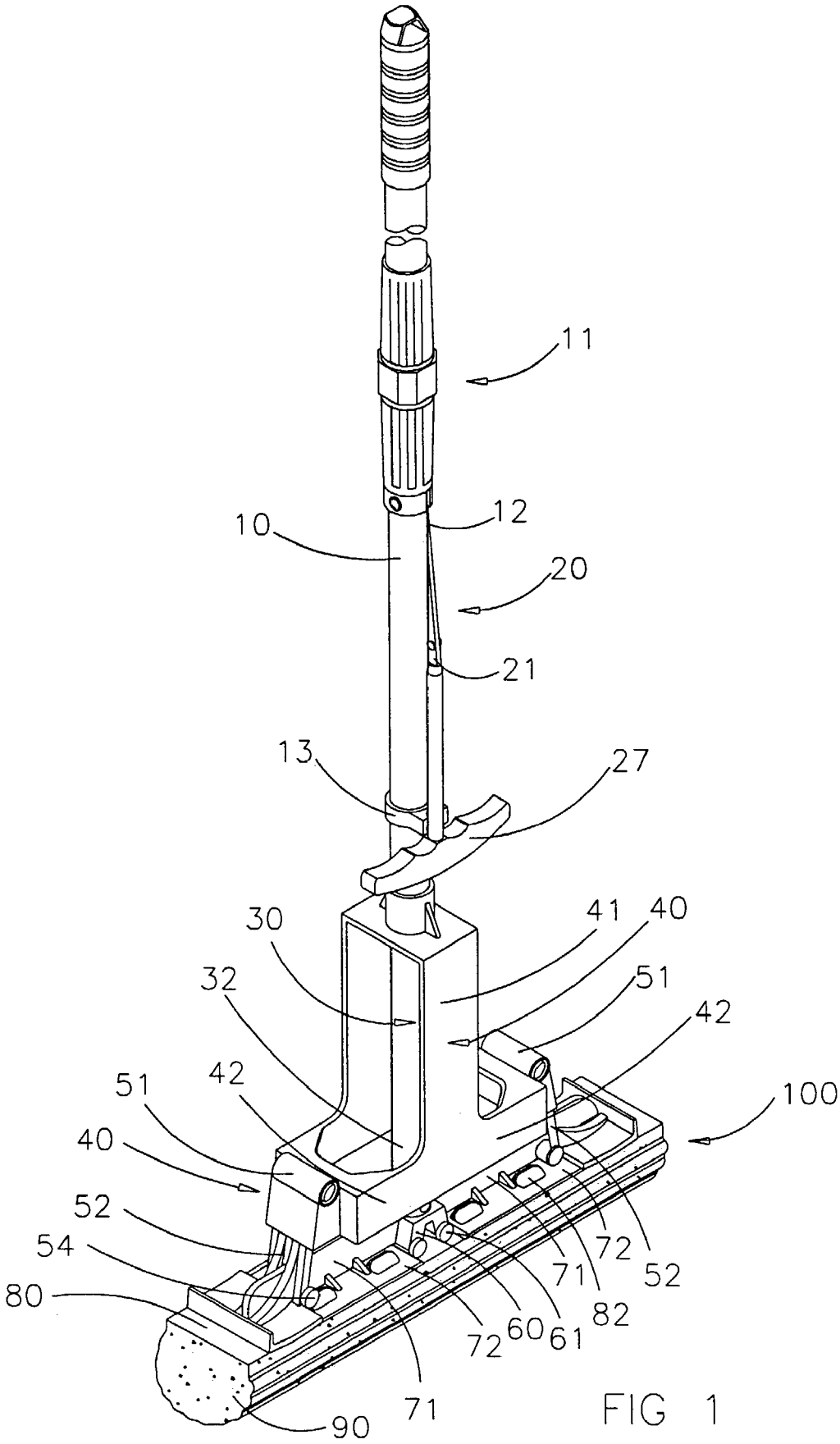
FIG. 1 is a perspective view of the sweeping and wringing apparatus of the present invention in the regular state.
Figure 2:
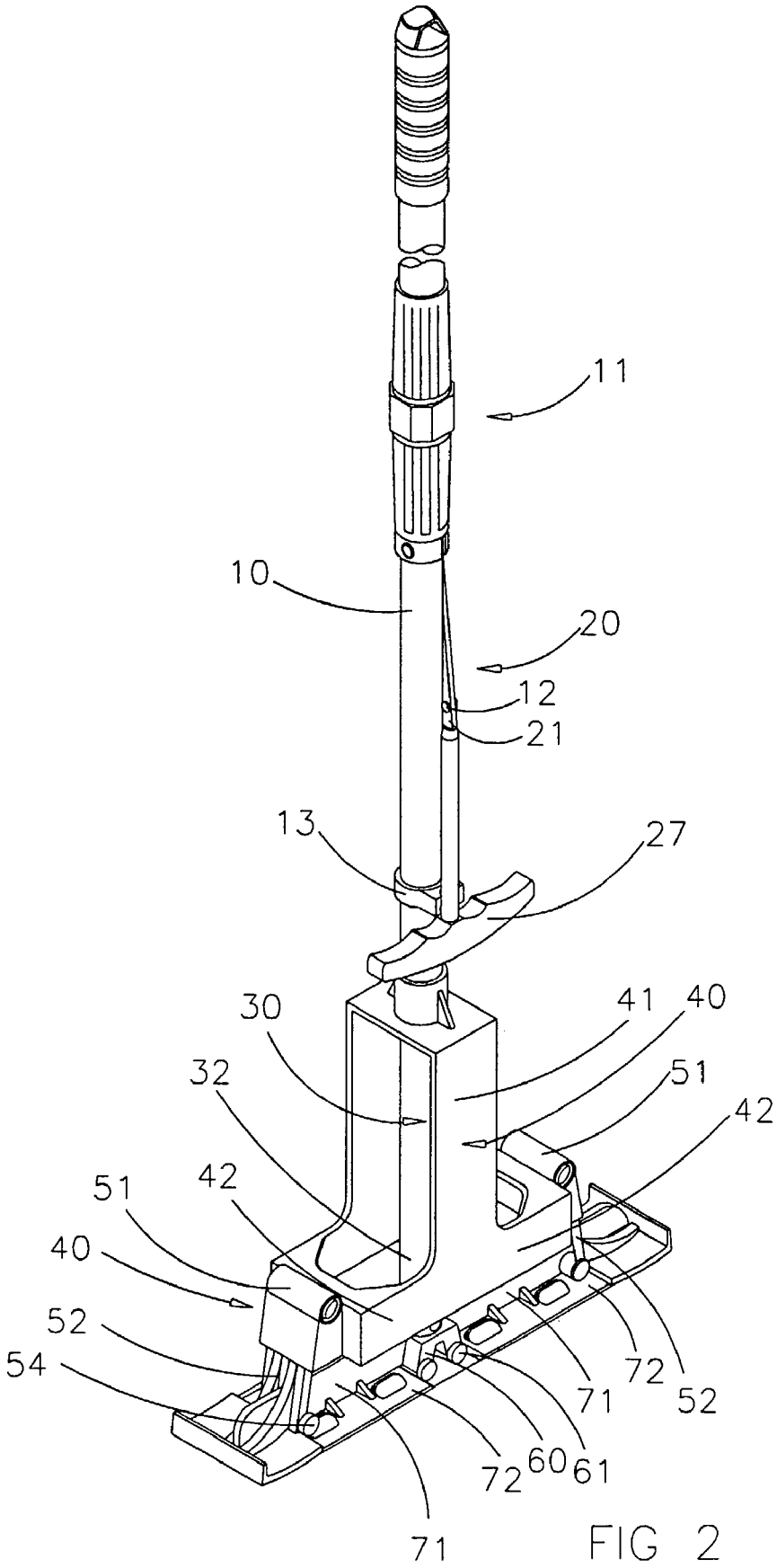
FIG. 2 is a schematic illustration of the sweeping and wringing apparatus of the present invention with the cleaning head dismounted and the transmission rod not pulled up (regular state).

As shown in FIGS. 1–8, the sweeping and wringing apparatus of the present invention comprises: a handle 10; a moving bar 20; a transmission rod 30; a frame 40; a pair of hinge plates 50, defining left and right sides; a pulling element 60; a pair of holding plates 70; and a cleaning head 100. The handle has a lower end to which the frame 40 is attached. The pair of hinge plates 50 are hingedly connected with opposite lower ends of the frame 40. The moving bar 20 is connected with the handle 10 and is used to drive a wringing movement. The transmission rod 30 runs inside the handle 10, being connected with the moving bar 20. The pulling element 60 is attached to the transmission rod 30. The pair of holding plates 70 extend to the left and right, being hingedly connected with and driven by the pulling element 60. The cleaning head 100 is mounted on a lower side of the pair of holding plates 70 and has an upper surface connected with the pair of hinge plates 50, thus being driven thereby in a squeezing movement.

The handle 10 is manually gripped at, having an upper end with an adjusting device 11 for adjusting the length of the handle 10. The adjusting device 11 is conventional art and therefore not described further. The handle 10 has an inner space which accommodates the moving bar 20 and the transmission rod 30.

Figure 6:
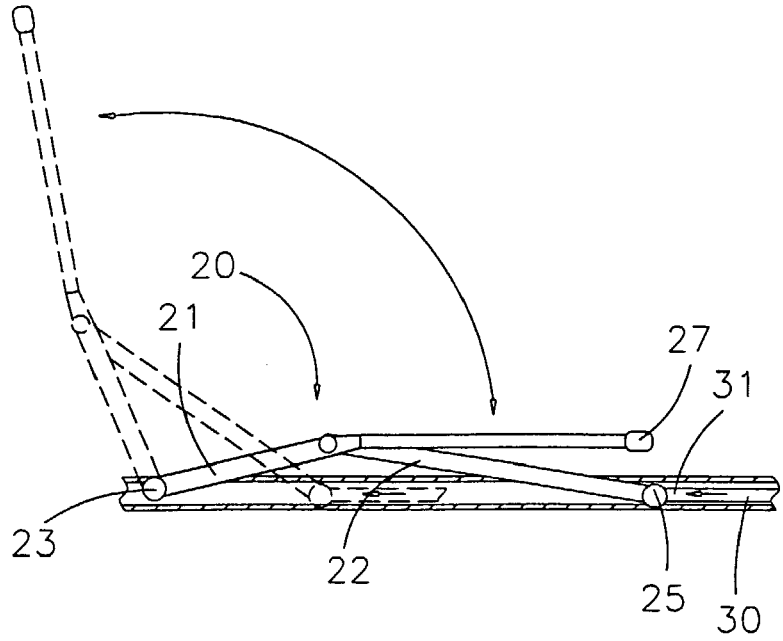
FIG. 6 is a schematic illustration of the movement of the moving bar of the present invention.

As shown in FIG. 6, the moving bar 20 has an upper rod 21 and a lower rod 22, which is connected with the upper rod at a middle position thereof. Furthermore, the moving bar 20 has an upper end 23, which is hingedly connected with the handle at a middle position thereof. The lower rod 22 has a lower end 25, which is hingedly connected with the handle at a lower position thereof and with the transmission rod 30, driving the transmission rod 30. The upper rod 21 and the lower rod 22 partly pass through an opening 12 of the handle 10. The upper rod has 21 a far end carrying a grip 27 that allows manually to pull out the moving bar 20. In a regular state, the upper rod 21 is held close to the handle 10 by an elastic clasp 13.

Figure 4:
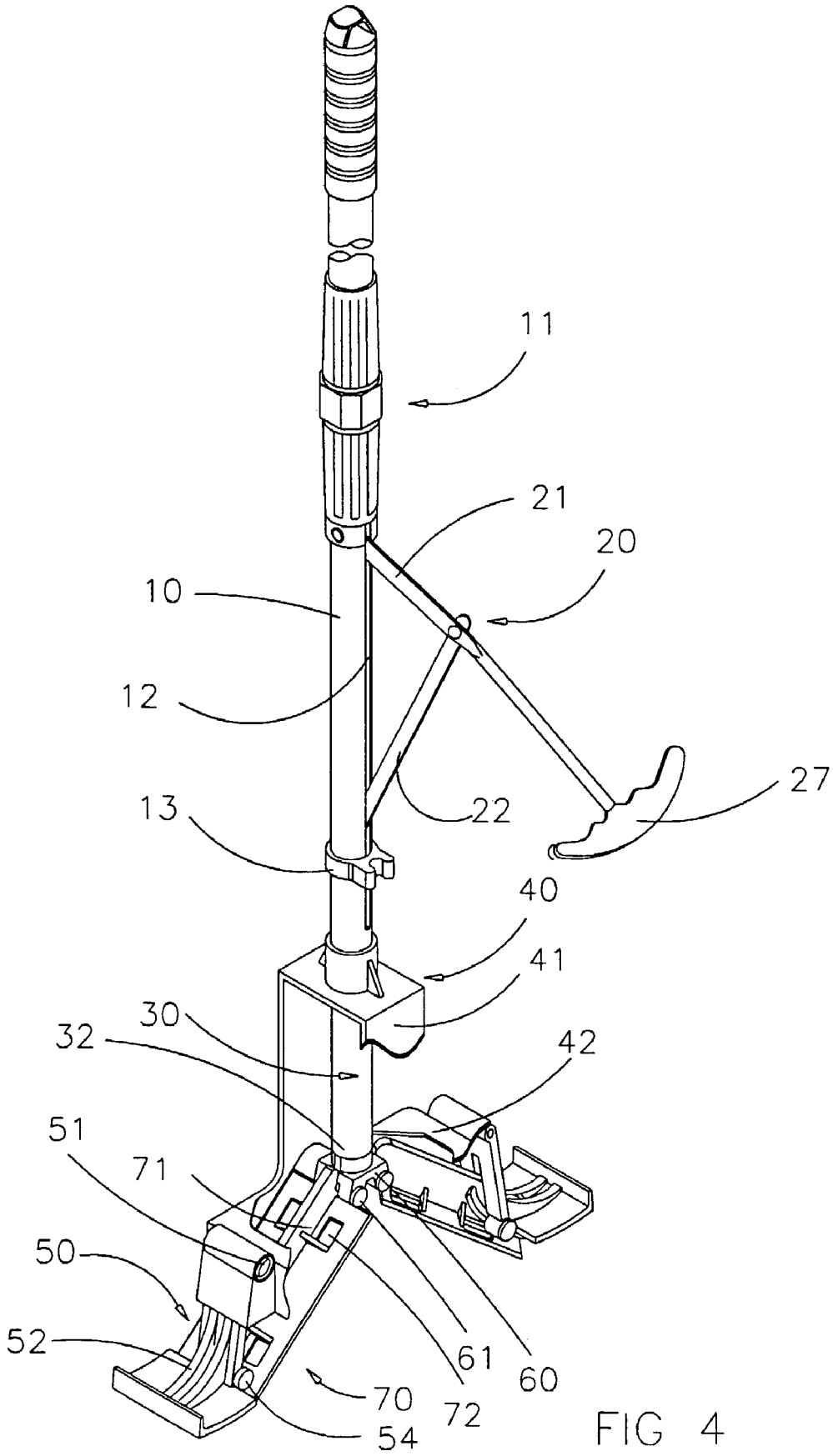
FIG. 4 is a schematic illustration of the sweeping and wringing apparatus of the present invention with the cleaning head dismounted and the transmission rod pulled up halfway.

As shown in FIGS. 4 and 6, the transmission rod 30 is partly accommodated in the handle 10, being able to glide therein upward and downward. The transmission rod 30 has an upper end 31, which is hingedly connected with the lower end 25 of the lower rod 22, and a lower end 32 is connected with the pulling element 60, driving the pulling element 60 downward.

The frame 40 is a hollow body, shaped like the inverted letter T, having a vertical part 41 connected with the lower end of the handle 10 and a horizontal part 42 with two far ends that extend away from the vertical part 41 to the left and right.

Figure 7:
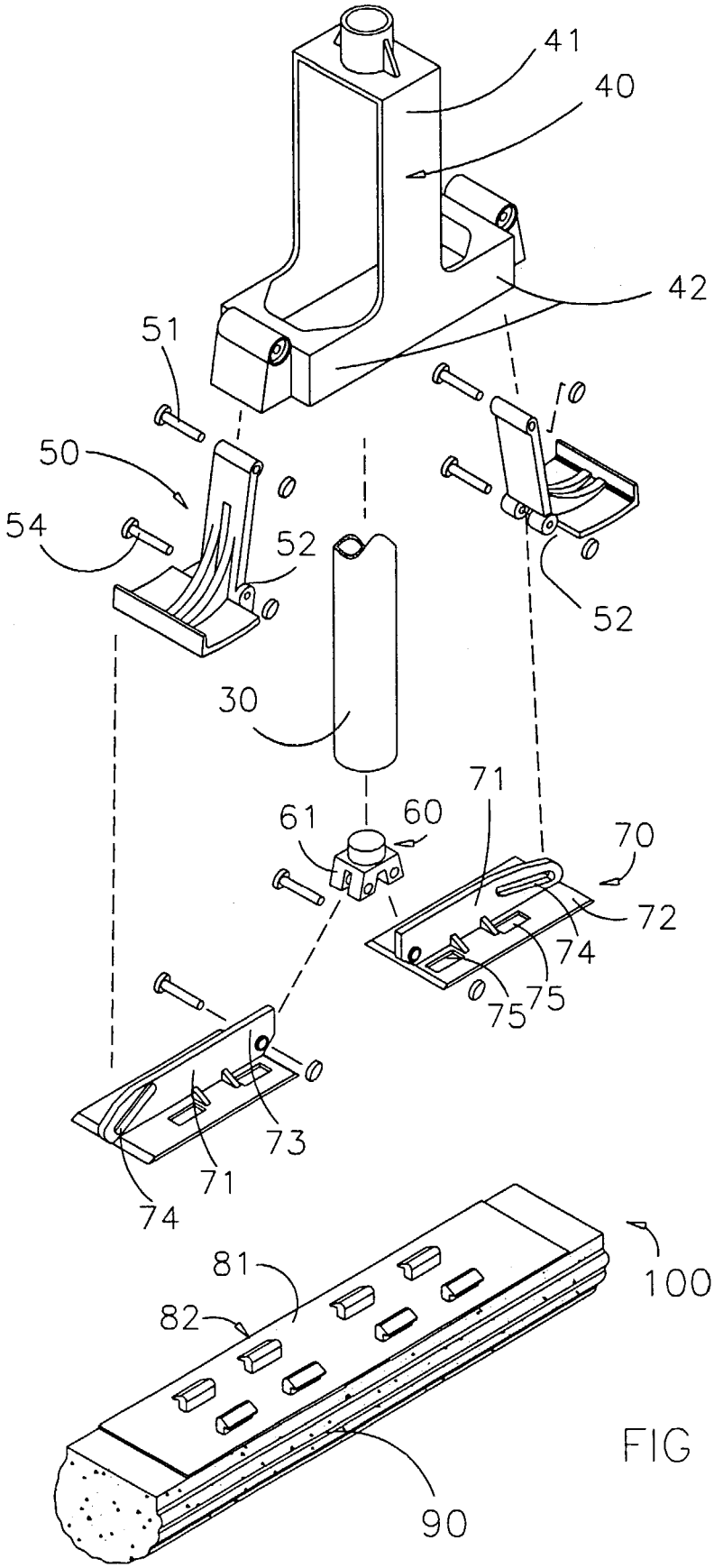
FIG. 7 is a perspective schematic illustration of the wringing system of the present invention at the lower part thereof.

Referring to FIG. 7, each of the pair of hinge plates 50 has a shape like the letter L, with a top end through which a bolt 51 passes to establish a hinged connection with one of the far ends of the horizontal parts 42. Furthermore, each of the pair of hinge plates 50 has a bent part 52 with a bolt 54 for connecting with the pair of holding plates 70.

The pulling element 60, being roughly shaped like the inverted letter T, is fixed on the lower end 32 of the control rod 30 and has a bottom part with two pulling hinges 61 to the left and right.

The pair of holding plates 70 are in a symmetric arrangement hingedly connected with the pulling hinges 61, having roughly T-shaped cross-sections. Each of the pair of holding plates 70 has a vertical rib 71 with an inner end 73, which is hingedly connected with one of the pulling hinges 61, and an outer end having a slanted elongated hole 74, which accommodates the bolt 54 of the bent part 52 of one of the hinge plates 50. Furthermore, each of the pair of holding plates 70 has a horizontal plate 72, which is provided with a plurality of holes 75 for holding the cleaning head 100.

Referring again to FIGS. 1 and 6, in the regular state, when the upper rod 21 of the moving bar 20 has not been pulled on, the upper rod 21 does not move the lower rod 22, so that no upward force is exerted on the transmission rod 30.

The cleaning head 100 is fastened to the pair of holding plates 70 by screws or by clamping or binding means. This is conventional art and therefore not described further.

Figure 3:
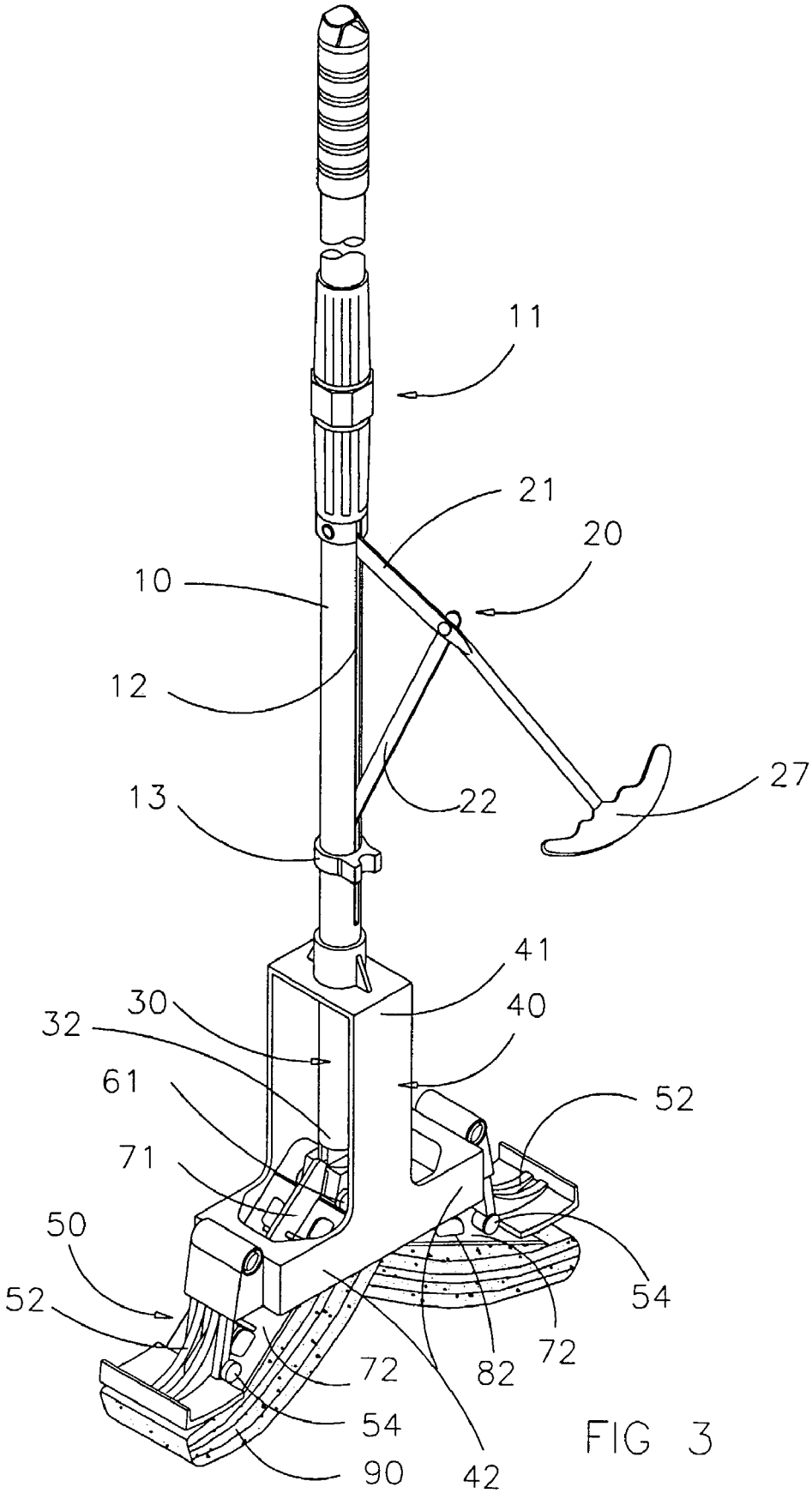
FIG. 3 is a schematic illustration of the sweeping and wringing apparatus of the present invention with the cleaning head mounted and the transmission rod pulled up halfway.

Referring to FIGS. 3 and 4, when the upper rod 21 of the moving bar 20 is pulled away from the handle 10, the lower rod 22 is moved along, so that an upward force is exerted on the transmission rod 30, drawing the pulling element 60 upward, which in turn causes the pulling hinges 61 to pull up the holding plates 70 at the inner ends 73 thereof. Thereby, the pair of holding plates 70 folds inward around the pulling hinges 61, in turn folding the cleaning head 100.

Figure 5:
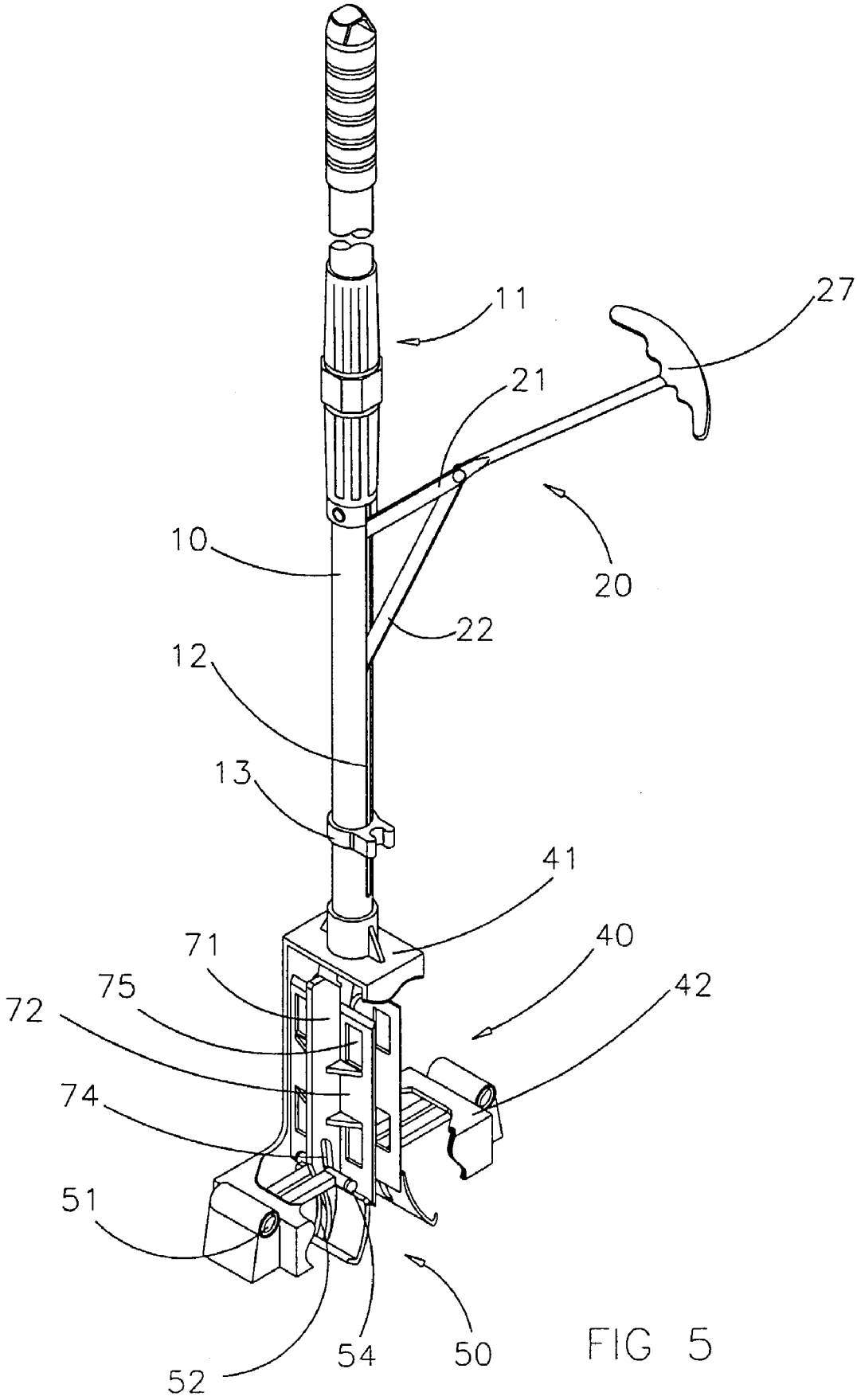
FIG. 5 is a schematic illustration of the sweeping and wringing apparatus of the present invention with the cleaning head dismounted and the transmission rod completely pulled up.

Referring to FIGS. 5 and 6, when the upper rod 21 of the moving bar 20 has reached an uppermost position, the transmission rod 30 has been drawn completely inside the handle 10, with the pair of holding plates 70 being completely folded together. Since the bolts 54 on the hinge plates 50 pass through the elongated holes 74 of the holding plates 70, the hinge plates 50 are drawn into the frame 40, as well. Thus the cleaning head 100 is folded and squeezed, so that water contained therein is readily wrung out.

Referring now to FIGS. 1–3 and 7–9, the cleaning head 100 comprises a positioning plate 80 and a cleaning element 90, held on a bottom side of the positioning plate 80. The cleaning element 90 is shaped like a strip of material capable of sucking water, like a sponge, cloth or plastics material. The present description uses a sponge, but this does not restrict the range of embodiments.

The positioning plate covers the cleaning element 90 from above, exerting squeezing pressure thereon (as shown in FIG. 3) to wring out water.

Figure 8:
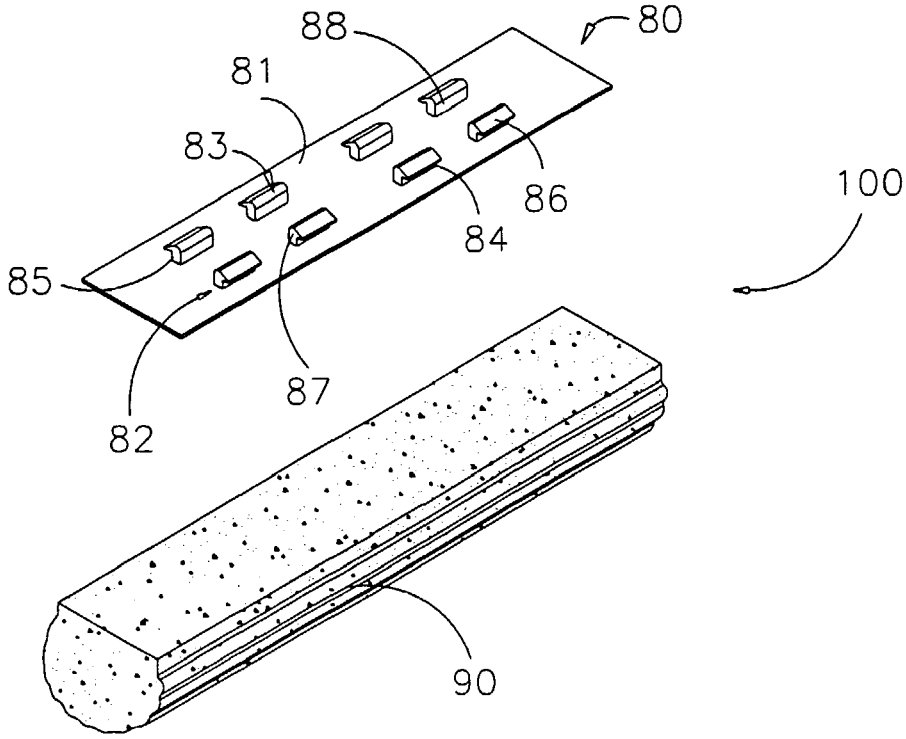
FIG. 8 is a perspective view of the cleaning head of the present invention.
Figure 9:
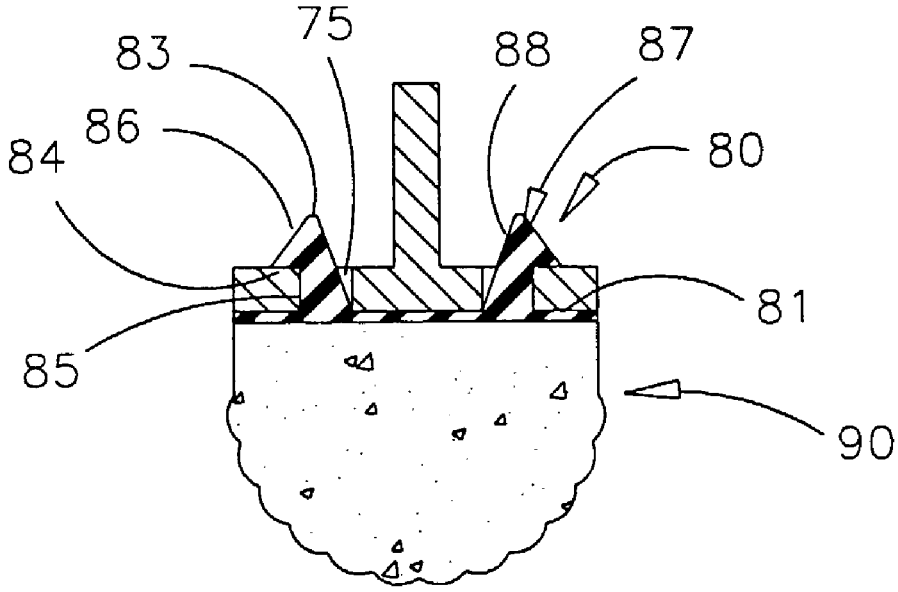
FIG. 9 is a cross-sectional schematic illustration mounting of the cleaning head on the pair of holding plates of the present invention.

As shown in FIGS. 7–9 the positioning plate 80 has a base plate 81 made of soft material and a plurality of hooks 82 on a top side of the base plate 81. For mounting the cleaning head 100, peaks 83 of the hooks 82 are inserted into the plurality of holes 75 of the pair of holding plates 70 to be held therein, so as to perform cleaning work.

Referring again to FIG. 1, in order to prevent damaging of furniture during the cleaning work, the positioning plate 80 is shorter than the cleaning element 90.

Each of the hooks 82 has a peak 83, a blocking part 84 and an embracing part 85. As shown in FIG. 9, for each of the hooks 82, the embracing part 85 allows to be pushed inward to lean on an inner wall of one of the holes 75, whereas the blocking part 84 grips an outer periphery thereof. Thus the hooks 82 hold the positioning plate 80 effectively on the holding plates 70.

To insert the hooks 82 conveniently into the holes 75 of the holding plates 70, for each of the hooks 82 the peak 83 has a front slope 86, a back slope 88 as well as left and right slopes 87.

To prevent the cleaning element 90 from falling off, the hooks are oriented back to back. Thus tensions exerted during the cleaning work are effectively countered by the blocking part 84 and the embracing part 85 of each of the hooks 82.

Figure 10:
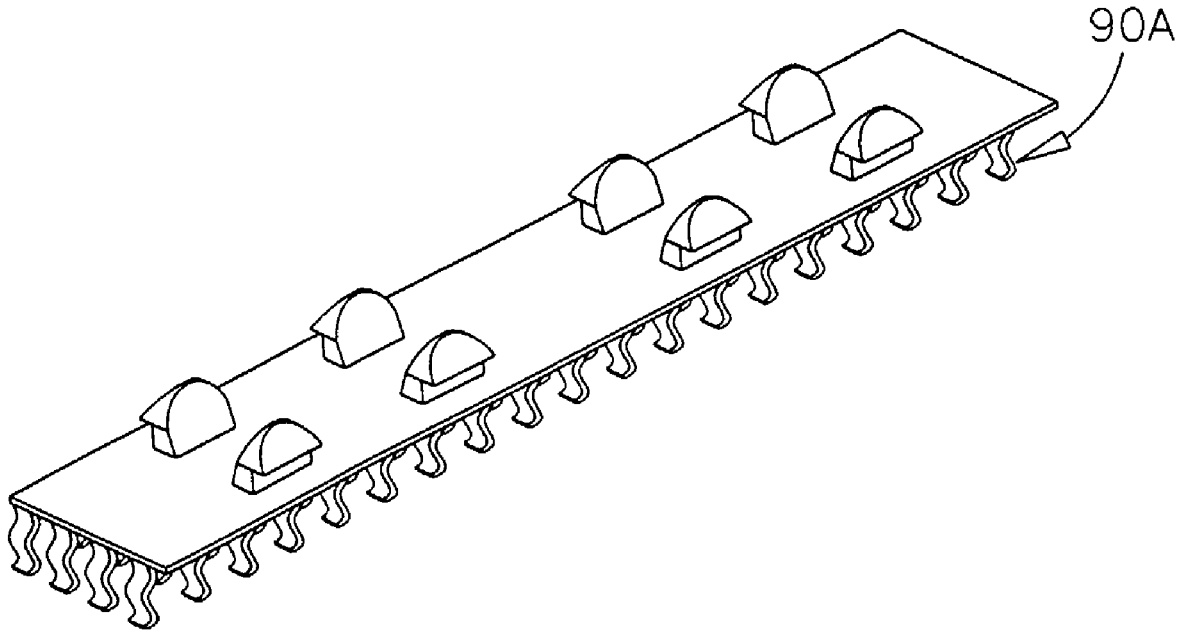
FIG. 10 is a schematic illustration of the cleaning head of the present invention in the second embodiment.
Figure 11:
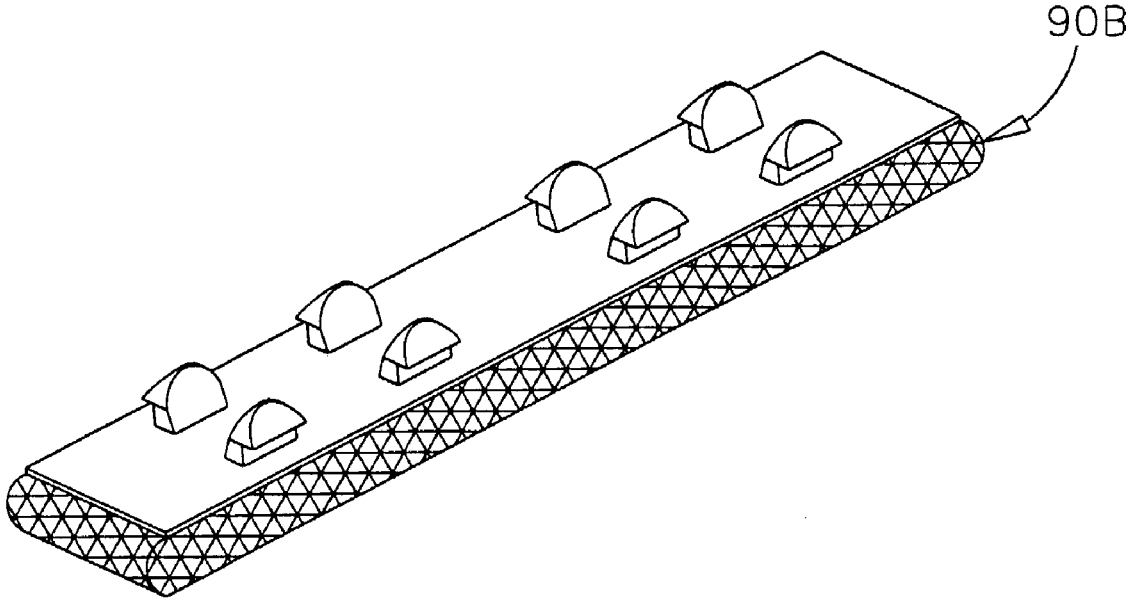
FIG. 11 is a schematic illustration of the cleaning head of the present invention in the third embodiment.
Figure 12:
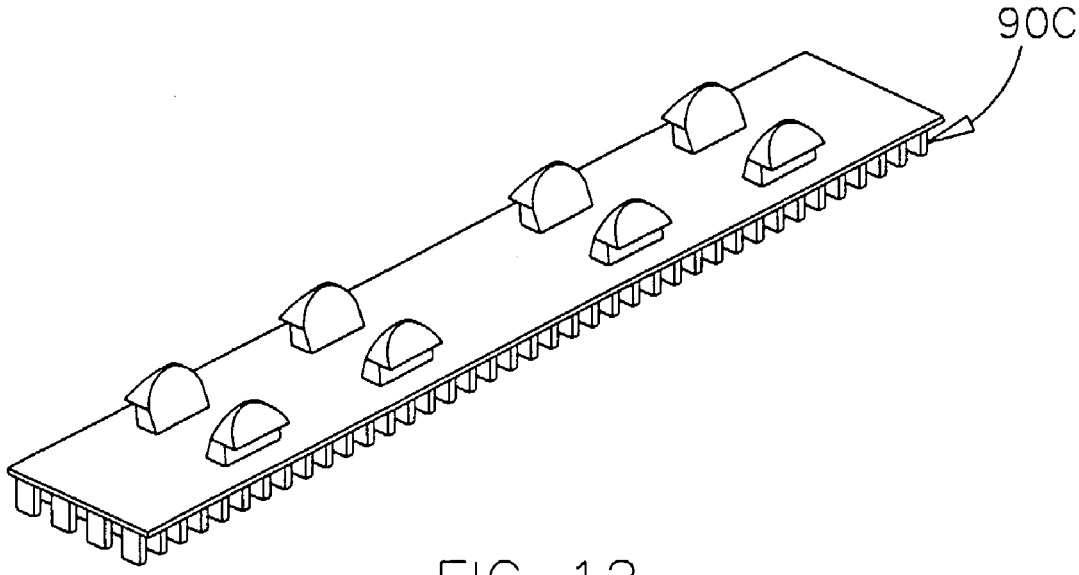
FIG. 12 is a schematic illustration of the cleaning head of the present invention in the fourth embodiment.
Figure 13:
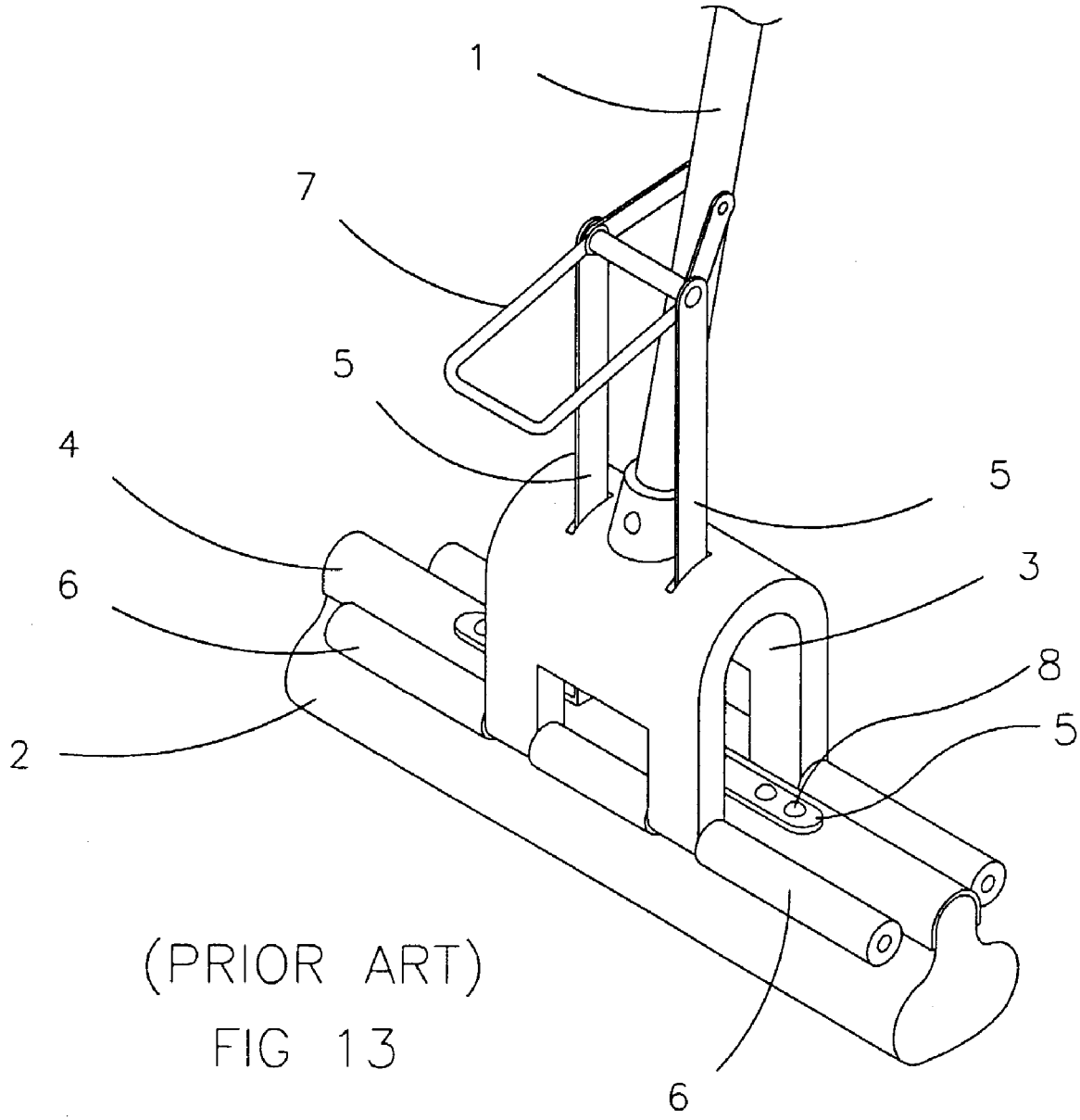
(PRIOR ART) FIG 13
FIG. 13 is a perspective view of a conventional sweeping and wringing apparatus.

Referring to FIGS. 10–12, the present invention in second to fourth embodiments has cleaning elements 90A, 90B and 90C, which are a plurality of textile strips, a textile mesh and a plurality of plastics strips, respectively. The cleaning elements 90A, 90B and 90C are fastened to the positioning plate 80 by gluing, screw or binding means, which is conventional art and therefore not explained further.

For mounting the cleaning head 100, first the hooks 82 on one side are inserted into holes 75, then the hooks 82 on the opposite side are inserted into holes 75. Of course, hooks 82 may be inserted in the order of one on the left and one on the right.

For dismounting the cleaning head 100, first the hooks 82 on one side are pressed inward and pulled out of holes 75, the hooks 82 on the opposite side are pressed inward and pulled out of holes 75. Again, hooks 82 may be pulled out in the order of one on the left and one on the right.

The sweeping and wringing apparatus of the present invention has the following advantages:

1. Manufacturing is easy and inexpensive.
2. Mounting and dismounting of the cleaning head is performed without tools.

3. Due to convenient dismounting of the cleaning head, the handle is taken advantage of effectively.
4. Being made of soft material, the cleaning head is easily squeezed and thus effectively wrung dry.

While the invention has been described with reference to preferred embodiments thereof, it is to be understood that modifications or variations may be easily made without departing from the spirit of this invention which is defined by the appended claims.

What is claimed is:

1. A sweeping and wringing apparatus, comprising:

a handle, which is a hollow body, defining a vertical direction;

a moving bar, having an upper end that is hingedly connected with said handle at a middle position thereof and a lower end that is placed inside said handle at a lower position thereof;

a transmission rod, glidingly mounted within said handle and having an upper end that is hingedly connected with said lower end of said moving bar and a lower end that extends downward beyond said handle;

a frame, which is a hollow body, having a vertical part with an upper end that is attached to said handle at a lower end thereof and a horizontal part with two far ends that define left and right sides;

a pair of hinge plates, each hinge plate of said pair of hinge plates being shaped like the letter L, having an upper end that is hingedly connected with one of said far ends of said horizontal part of said frame and having a bent part with a bolt;

a pulling element, attached to said lower end of said transmission rod;

a pair of holding plates, having vertical ribs with inner ends that are hingedly connected with said pulling element and extending symmetrically to the left and right, respectively; and a cleaning head, shaped like an elongated square block and fastened to said pair of holding plates;

wherein, when said moving bar is pulled up in a squeezing movement, said lower end thereof takes said transmission rod upward, which in turn via said pulling element pulls up said pair of holding plates at said inner ends thereof, so that said pair of holding plates are folded inward, causing said cleaning head to be folded, with continuing said squeezing movement resulting in water contained in said cleaning head to be wrung out, and wherein by reversing said squeezing movement an original state is reinstated.

2. The sweeping and wringing apparatus according to claim 1, wherein said handle in a middle section has an opening, partly accommodating said moving bar during said squeezing movement thereof.

3. The sweeping and wringing apparatus according to claim 1, wherein said moving bar further comprises an upper rod and a lower rod, which is hingedly connected to said upper rod at a middle position thereof.

4. The sweeping and wringing apparatus according to claim 1, wherein for each holding plate of said pair of holding plates, said vertical rib has an outer end into which an elongated hole is cut, passed through by said bolt of one of said pair of hinge plates, thus controlling how said pair of holding plates move during said squeezing movement.

5. The sweeping and wringing apparatus according to claim 4, wherein for each holding plate of said pair of holding plates, said elongated hole is oriented in a slanted direction.

6. The sweeping and wringing apparatus according to claim 1, wherein each holding plate of said pair of holding plates has a horizontal plate with a plurality of holes.

* * * * *